United States Patent [19]

Rice et al.

[11] 4,424,681

[45] Jan. 10, 1984

[54] HYDRAULIC REFRIGERATION SYSTEM AND METHOD

[75] Inventors: Warren Rice, Tempe; Craig Hosterman, Scottsdale, both of Ariz.

[73] Assignee: Natural Energy Systems, Tempe, Ariz.

[21] Appl. No.: 388,227

[22] Filed: Jun. 14, 1982

[51] Int. Cl.[3] ..... F25B 1/00; F25B 1/06

[52] U.S. Cl. ..... 62/114; 62/500

[58] Field of Search ..... 62/114, 115, 119, 500

[56] References Cited

U.S. PATENT DOCUMENTS 4,157,015 6/1979 Hosterman et al. ..... 62/115

4,251,998 2/1981 Hosterman et al. ..... 62/115

*Primary Examiner*—Lloyd L. King

*Attorney, Agent, or Firm*—Cahill, Sutton & Thomas

[57] ABSTRACT

A gaseous refrigerant fluid is entrained within a down pipe of a closed loop liquid carrier flow circuit to compress isothermally the refrigerant fluid in a gaseous state to a near liquid state. A separation chamber at the lower extremity of the down pipe separates the refrigerant from the carrier and the carrier is drawn off. The carrier is conveyed upwardly through a return pipe and by a pump to a further pipe for reintroduction to the down pipe at the upper end thereof. The separated refrigerant fluid is further compressed but without changing its state by a mechanical compresser of small compression ratio and is cooled in a heat exchanger within the carrier return pipe, which cooling converts it to a liquid state. Thereafter, the refrigerant fluid is pumped by a liquid refrigerant pump upwardly through a return pipe and through an expansion valve. The refrigerant fluid, converted to a quality mixture of vapor and liquid by the expansion valve, flows through an evaporator to cool a medium, such as air, passing therethrough. The refrigerant fluid, flowing from the evaporator and in a gaseous state, is introduced to the upper end of the down pipe for re-entrainment in the carrier.

22 Claims, 6 Drawing Figures

*NOMENCLATURE*

| | |
|---|---|
| $A$ | CROSS-SECTIONAL AREA ($L^2$) |
| $c_\ell$ | SPECIFIC HEAT (OF WATER) (FL/MO) |
| $C_D$ | DRAG COEFFICIENT (DIMENSIONLESS) |
| COP | COEFFICIENT OF PERFORMANCE |
| $d$ | VERTICAL DISTANCE (WHEN SUBSCRIPTED) (L) |
| $d$ | DIFFERENTIAL OPERATOR (WHEN NOT SUBSCRIPTED) |
| $D$ | DROPLET OR BUBBLE DIAMETER (L) |
| $F$ | FORCE (F) |
| $g$ | GRAVITATIONAL CONSTANT ($L/T^2$) |
| $h$ | ENTHALPY (FL/M) |
| $K$ | PRESSURE LOSS OR RECOVERY COEFFICIENT (DIMENSIONLESS) |
| $\dot{m}$ | MASS FLOW RATE (M/T) |
| $p$ | PRESSURE ($F/L^2$) |
| $P$ | POWER (FL/T) |
| $\dot{Q}_{ref}$ | REFRIGERATION (FL/T) |
| $R$ | $\dot{m}_f/\dot{m}_e$, THE MASS RATIO OF REFRIGERANT TO WATER |
| $s$ | CIRCUMFERENCE (L) |
| $T$ | TEMPERATURE ($\theta$) |
| $v$ | VELOCITY (L/T) |
| $x$ | QUALITY (DIMENSIONLESS) |
| $z$ | VERTICAL COORDINATE (L) |
| $\Delta$ | DIFFERENCE OPERATOR |
| $\rho$ | DENSITY ($M/L^3$) |
| $f$ | FLUID FRICTION FACTOR (DIMENSIONLESS) |
| $\mu$ | VISCOSITY ($FL/L^2$) |
| $\eta$ | EFFICIENCY (DIMENSIONLESS) |

fig. 3

SUBSCRIPTS

| | |
|---|---|
| 0, 1, ..., 12 | LOCATIONS AND/OR STATE DESIGNATIONS |
| B | BOUYANT |
| D | DRAG |
| d | DOWNPIPE |
| f | REFRIGERANT |
| f | SATURATED LIQUID, WHEN SUBSCRIPTING ENTHALPY |
| fg | DIFFERENCE BETWEEN SATURATED VAPOR AND SATURATED LIQUID, WHEN SUBSCRIPTING ENTHALPY |
| fp | LIQUID-REFRIGERANT PUMP |
| $\ell$ | PRIMARY-FLUID (WATER) |
| r | RELATIVE |
| ref | REFRIGERATION |
| R | REFERENCE |
| t | REFRIGERANT SUPPLY PIPE (STATE 1) |
| tot | TOTAL |
| u | UPPIPE |
| wp | WATER PUMP |
| z | LOCAL VALUE AT LOCATION INDICATED BY z |

fig. 3a

HYDRAULIC REFRIGERATION SYSTEM AND METHOD

This application is related to the inventions described in U.S. Pat. No. 4,157,015 entitled "HYDRAULIC REFRIGERATION SYSTEM AND METHOD", U.S. Pat. No. 4,311,025, entitled "GAS COMPRESSION SYSTEM" and U.S. Pat. No. 4,251,998 entitled "HYDRAULIC REFRIGERATION SYSTEM AND METHOD", all of which patents are assigned to the present assignee.

The present invention relates to refrigeration systems and, more particularly, to refrigeration systems employing isothermal instead of adiabatic compression processes to liquify the refrigeration fluid.

The principle of entrapping and compressing air by movement of water, i.e., using a hydraulic air compressor or "trompe", as it is called, has been employed industrially in the United States for some years. In one such installation, air is drawn into a down flowing stream of water and trapped within a cavernous underground chamber where the head of water maintains it under compression. The air may be permitted to escape through a pneumatic engine or turbine; thus, power may be generated.

Various proposals have been made in the prior art to use the abundant wave energy of the sea for producing power. Because of the potential power available from the ocean, many ingenious suggestions have been made for harnessing some of the power. Among such suggestions are some that include generation of electricity, as described in U.S. Pat. No. 3,064,137. Therein, it is suggested that the energy of the ocean waves be used to cyclically feed a down pipe and entrap a column of air. The column is replenished and repressurized from wave to wave. The compressed air is finally expanded through a turbine driving an electrical generator to produce electrical energy storable in a battery. U.S. Pat. No. 3,754,147, describes a related system wherein the electricity generated is employed for electrolysis purposes.

In refrigeration systems, the major operating costs arise from the costs attendant energization of a mechanical compressor to compress adiabatically the refrigerant. Additionally, the cost of such a compressor is a substantial part of the initial cost of the refrigeration system itself. Thus, it would be beneficial from the standpoint of both initial and operating costs to eliminate the need for a mechanical compressor in a refrigeration system.

The present invention is directed to a refrigeration system which employs the principles of operation of a "trompe" system for effecting isothermal compression of the refrigerant fluid to a near liquid state. To provide the requisite head to the liquid carrier to effect compression of the refrigerant fluid, a pump for pumping the carrier through a closed loop is employed. After separation of the refrigerant fluid from the carrier, a compressor having a low compression ratio further compresses the refrigerant fluid without altering its state. Conversion of the refrigerant to a liquid state is effected by passing it through an heat exchanger in the carrier return pipe to cool it. The liquid refrigerant fluid may now be passed through mesne refrigeration units and returned to the trompe system in gaseous state.

It is therefore a primary object of the present invention to employ as isothermal compression process in a refrigeration system.

Another object of the present invention is to provide an inexpensive refrigeration system.

Yet another object of the present invention is to provide a hydraulic flow system for compressing the refrigerant fluid of a refrigeration system.

Still another object of the present invention is to provide a refrigeration system having a closed loop carrier liquid system for compressing a refrigerant fluid in a gaseous state and employing a low compression ratio compressor and an heat exchanger to convert the refrigerant fluid into a liquid state in a closed loop refrigeration system.

A further object of the present invention is to provide a means for entraining a refrigerant fluid within a downward flow of a carrier more dense than the refrigerant fluid to effect compression of the refrigerant fluid within a minimum vertical flow distance.

A yet further object of the present invention is to provide a means for compressing and condensing the refrigerant fluid in a refrigerant system by entraining the refrigerant fluid within a downwardly flowing liquid carrier to compress the refrigerant fluid to a near liquid state, separating the compressed gaseous refrigerant fluid from the carrier, mechanically further compressing the refrigerant fluid and converting the refrigerant fluid into a liquid state in a heat exchanger.

These and other objects of the present invention will become apparent to those skilled in the art as the description thereof proceeds.

The present invention may be described with greater specificity and clarity with reference to the following drawings, in which.

Figure 4:
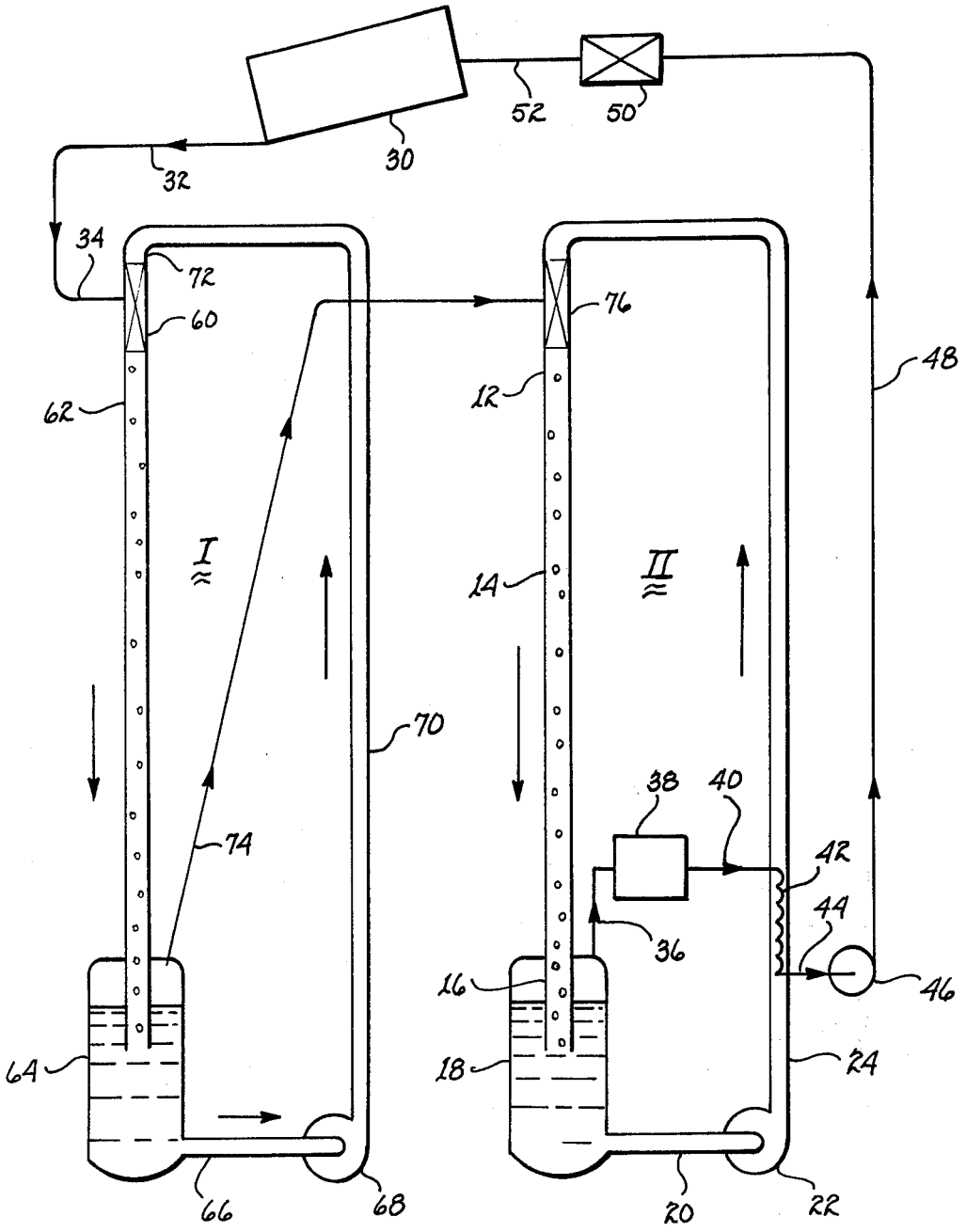

FIGS. 3 and 3*a* represent legends;

FIG. 4 illustrates a first variant; and

Figure 5:
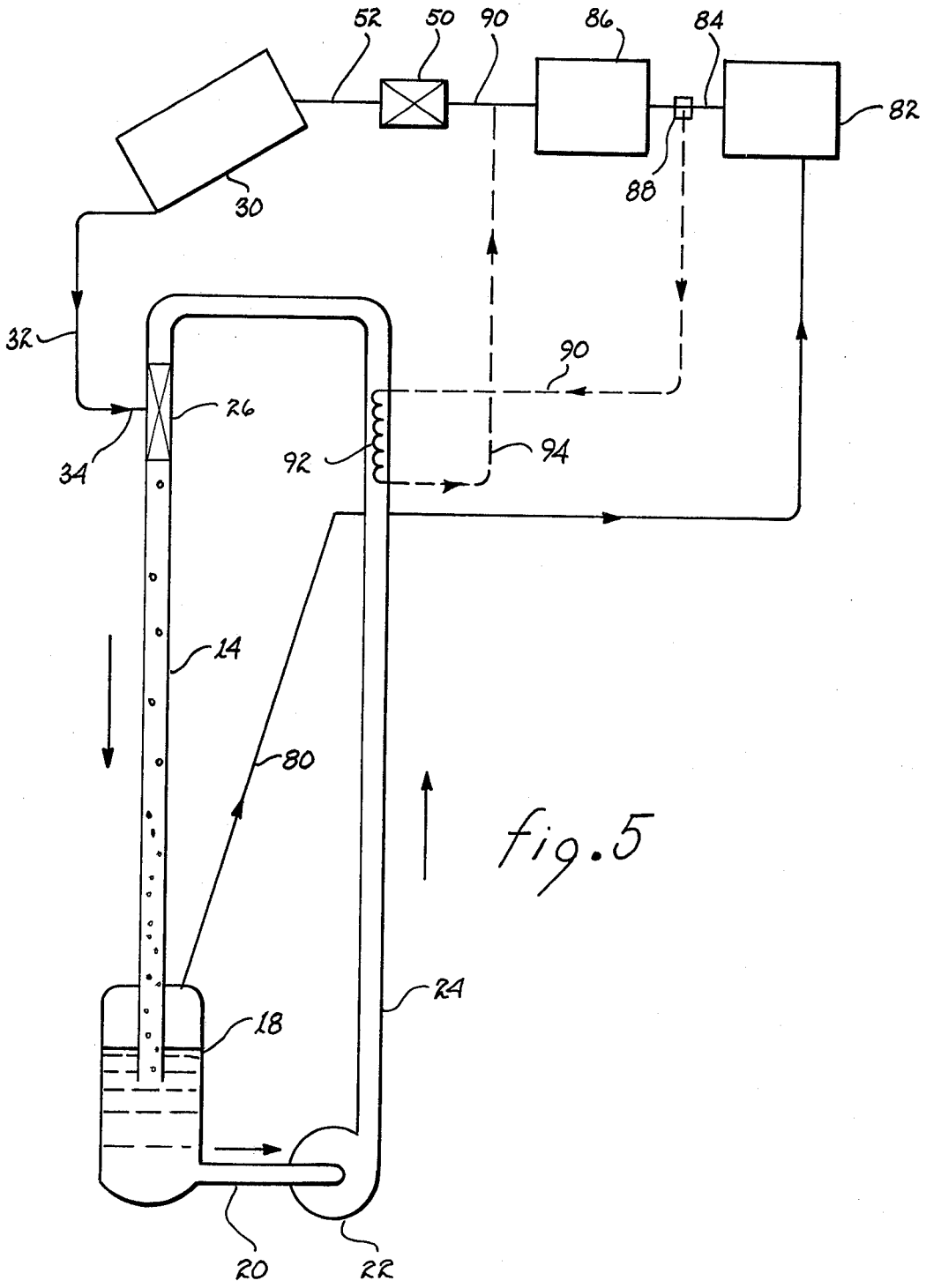

FIG. 5 illustrates a second variant.

Figure 1:
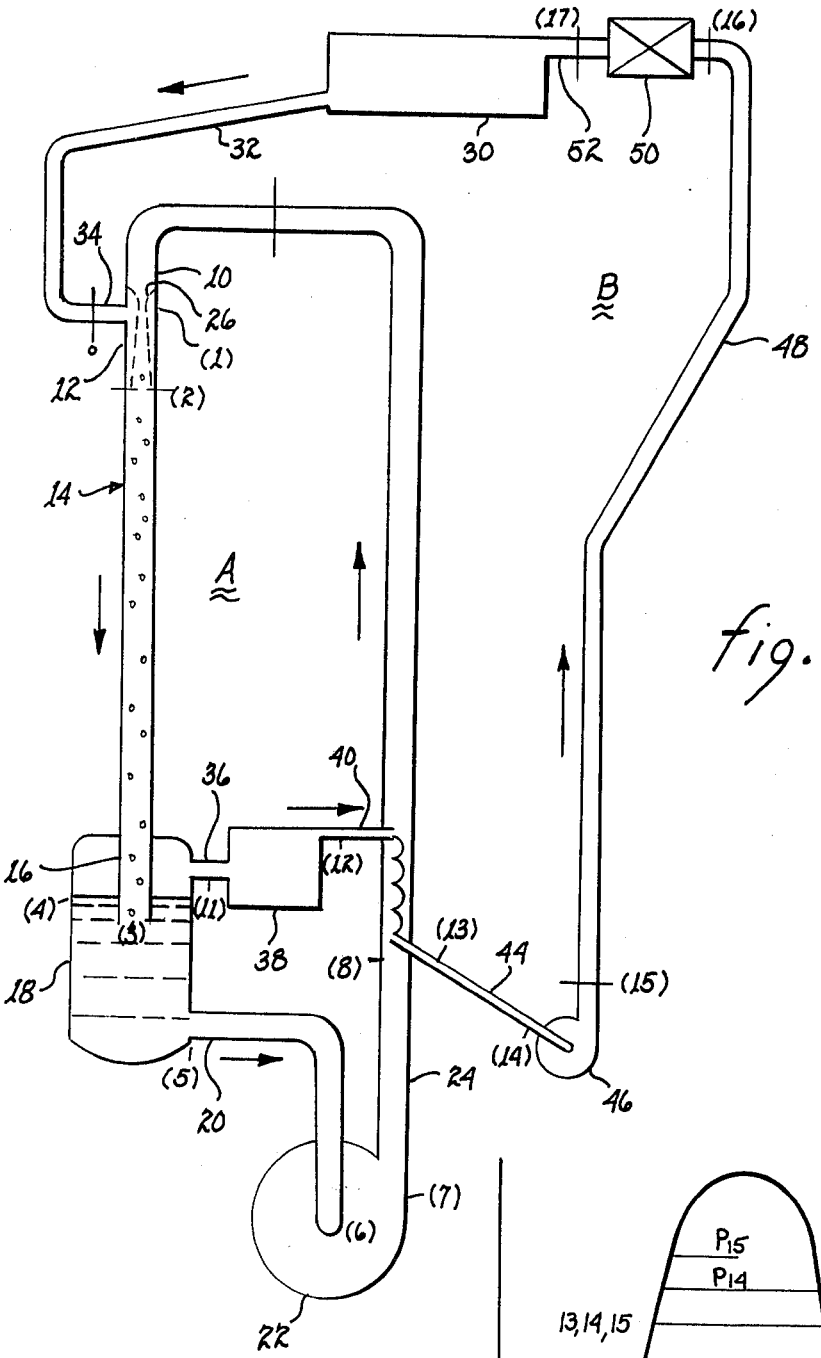
FIG. 1 is a schematic diagram of the hydraulic refrigeration system.

Referring to FIG. 1, there is shown a hydraulic refrigeration system divisible into two coacting interrelated subsystems, a carrier system A and a refrigeration system B. The carrier system includes an inlet pipe 10 in fluid communication with upper end 12 of a down pipe 14. Lower end 16 of the down pipe feeds a separation chamber 18. The chamber may be clyindrical, as shown, rectangular, hopper shaped or trough shaped. An outlet pipe 20 serves as a conduit for the carrier to a pump 22. The carrier is transmitted from the pump through return pipe 24 into inlet pipe 10. An entrainer, such as a venturi 26, is disposed at upper end 12 of the down pipe for the purpose of reducing the pressure of the fluid flowing past the inlet by increasing the flow velocity.

Refrigeration system B includes an evaporator 30 in which the cooled referigerant fluid absorbs heat from a medium to be cooled (such as air) passing therethrough. The refrigerant fluid flowing out of the evaporator and through pipe 32 is in a gaseous state and generally superheated. Outlet 34 of pipe 32 is disposed in proximity to venturi 26 at upper end 12 of the down pipe. The gaseous refrigerant fluid discharged through outlet 34 will become entrained within the carrier flowing downwardly through the venturi and drawn into down pipe 14. Thereby, the refrigerant fluid is conveyed downwardly to separation chamber 18 and compressed by the carrier commensurate with the downward flow.

Within the separation chamber, the refrigerant fluid, being in a gaseous state, will percolate to the top. The pressure present within separation chamber 18, induced by the head of the carrier in down pipe 12, urges flow of the refrigerant fluid through pipe 36 to a low compression ratio refrigerant compressor 38. The compressor increases the pressure of the refrigerant fluid to a pressure just more than that necessary to convert it to a liquid state at the liquid carrier temperature and pumps it through pipe 40 to an heat exchanger 42. The heat exchanger is disposed within return pipe 24 and is subjected to the cooling effect of the carrier flowing therethrough. Upon cooling, the refrigerant fluid is converted to a liquid state. The liquid refrigerant fluid flows through pipe 44 to pump 46, which pump pumps it through pipe 48 to expansion valve 50. The chilled refrigerant fluid, converted to a partly vapor and mostly liquid state by the expansion valve flows through pipe 52 to evaporator 30. The state of the refrigerant fluid may be called a "low quality mixture state"; its temperature is low and corresponds to the refrigeration temperature. The pressure after the expansion valve is not necessarily low, although it is the lowest pressure in the system, and corresponds with the desired temperature in the evaporator in the "saturation property tables" for whatever refrigerant is in use, as is well known.

Expansion valve 50 may be of any one of several physical forms and several control modes for it are possible. One particular type is, however, preferred and is known as a "constant superheat expansion control valve". In operation, it maintains a specific temperature of the refrigerant fluid (such as Freon 12) leaving the expansion valve regardless of the pressure of the liquid refrigerant supplied to the valve.

A surge tank (not shown) may be connected in fluid communication with inlet pipe 10. As the refrigeration load changes at the evaporator, the volume of bubbles of refrigerant fluid will vary. Thus, the surge tank allows the carrier to leave or enter system A, as required, to keep the volume ratio of carrier and refrigerant fluid constant. Conduits may be incorporated to allow the carrier level in the surge tank to vary with very nearly constant pressure being maintained in the surge tank.

From the above description, it will become apparent that carrier system A is a simple closed loop system for developing a downward flow through down pipe 14 and a pressure within separation chamber 18 commensurate with the head of the column of carrier. Refrigeration system B includes a low compression ratio compressor, a liquid refrigerant liquid pump 31, a conventional expansion valve 29 and a conventional evaporator 25. The function performed by conventional condensers and compressors are achieved by down pipe 14, separation chamber 18 and heat exchanger 42, as will be described in detail below.

The refrigerant fluid is in a superheated gaseous state at the point of discharge through outlet 34. On discharge, the refrigerant fluid is injected into the carrier within down pipe 14 in the form of bubbles. These bubbles become entrained within the downward flow of carrier in proximity to outlet 34. Entrainment of the bubbles can be promoted by incorporating a venturi 26, as shown. The carrier flow is accelerated by forcing it through the venturi and discharging the carrier downwardly into pipe 14. The accelerated carrier flow rate presents a low pressure environment entrains the refrigerant fluid. Downstream, pipe 14 enlarges in diameter resulting in a reduced flow rate and a substantial pressure increase. Thus, the pressure at location (2) is increased over that at location (1).

The entrained bubbles quickly acquire the same temperature and pressure as the surrounding carrier in pipe 14. These bubbles are carried downwardly by the carrier due to their entrainment therein. The bubbles have an upward drift velocity relative to the carrier, which drift is at a lower velocity than the downward carrier flow velocity. Continuing downward movement of the bubbles results in a pressure increase commensurate with depth or head of the carrier at any given location. At some location along down pipe 14, represented by numeral (3), the ambient pressure corresponds with a pressure just less than the saturation pressure for the refrigerant fluid at the there existing temperature. At location (4) separation of the gaseous refrigerant fluid from the liquid carrier occurs and the carrier less the refrigerant fluid flows into pipe 20 at location (5). The inlet (6) to pump 22 is maintained vertically below (5) to provide sufficient pressure to prevent cavitation at the pump inlet. The carrier undergoes pressurization between locations (6) and (7) and various pressure losses are incurred serially between locations (7), (8), (9), (10) and (1).

The gaseous refrigerant fluid within separation chamber 18 is expelled therefrom into pipe 36 due to the pressure head created within the separation chamber primarily by the carrier in down pipe 14, and enters as a carrier free gas at refrigerant compressor 38, location (11). The compressor increases the pressure of the refrigerant fluid at location (12) to a value just exceeding the saturation pressure at the liquid carrier temperature. Heat exchanger 42 disposed in the path of the carrier reduces the temperature of the refrigerant fluid to a value sufficient to convert it to a liquid state at location (13). Pump 46 is situated below location (13) to insure sufficient pressure at inlet (14) to prevent cavitation. The purpose of the pump is that of ensuring that the refrigerant fluid at location (16) is still entirely liquid. Expansion valve 50 reduces the temperature of the refrigerant fluid at location (17) to a value commensurate with that desired in the evaporator. Within the evaporator, the refrigerant fluid, entering as a quality mixture, absorbs heat from the medium passing therethrough and the refrigerant fluid becomes at least slightly superheated vapor at location (0).

Since heat is continually transferred from the refrigerant within down pipe 14 to the surrounding carrier, the temperature of the carrier will rise unless the heat can be absorbed by a heat sink. The requisite heat sink may be provided by the earth surrounding carrier system A in the event the latter is buried within the ground; alternatively, cooling fins may be employed to transfer heat to the ambient air. Other forms of heat sinks are well known and may also be incorporated.

The hydraulic refrigeration system may be considered a cycle-type refrigeration system in the conventional thermodynamic sense. That is, work is added to the cycle by the pumps, heat is rejected from the cycle by the down pipe to the surrounding earth or other heat exchanger and heat is added to the cycle at the evaporator. Accordingly, the cycle described is in accord with the second law of thermodynamics from both the qualitative and quantitative standpoints.

In analyzing the present invention from the thermodynamic standpoint, several observations may be made. The compression and heat rejection phases of a refrigeration system are simultaneously performed in the down pipe. The carrier pump, the low compression ratio refrigerant compressor and the liquid refrigerant pump are the only moving parts of the system. Compression of the refrigerant to near liquid state is virtually isothermal at the carrier temperature, which is the preferred compression process. Finally, the earth or ground is useable as a heat sink at least in some circumstances.

It is not possible to arbitrarily choose the thermodynamic conditions to be achieved at the various locations within the refrigeration system and thereafter calculate the performance of the system. Instead, one must choose the temperature preferred at the evaporator and the amount of refrigeration wanted; thereafter, all other parameters of the system are determinable by calculation to assure satisfaction of the first law of thermodynamics, the law of conservation of momentum and the law of conservation of mass.

In the following analysis, the equations are statements of satisfaction of the above identified laws and all of the equations together constitute a mathematical model of the hydraulic refrigeration system. Various idealizations are necessarily incorporated into such a model and may be slight departures from reality. The primary idealization in the following mathematical analysis is one-dimensionality of the flow.

In the following analysis, various symbology is used and a legend therefore appears in FIGS. 3, 3*a*.

It is to be understood that while freon and water are a likely combination for use in a hydraulic refrigeration system, any other combination of carrier and refrigerant fluid that are not miscible could be used; in example, Freon 113 and Freon 114. Such or other more dense carrier is preferred provided that the bubbles of the refrigerant fluid could be entrained therein and provided that the carrier were not miscible with the refrigerant fluid. The more dense the carrier, the less is the required effective vertical height of the system and savings in construction and maintenance costs are achieved.

Mathematical modeling of the invention results in equations which must be solved simultaneously using a digital computer. The programming of the equations is such that all dimensions, pressures, temperatures, pump power, cycle performance, etc., are calculated automatically when the program is supplied with the refrigerant fluid designation, evaporator temperature and desired tonnage of refrigeration.

Figure 2:
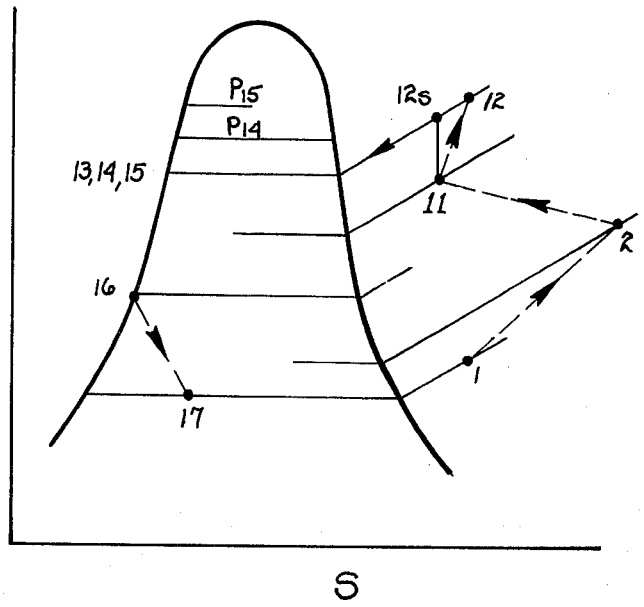
FIG. 2 is a thermodynamic state diagram representative of the hydraulic refrigeration system.

In addition to the legend in FIGS. 3, 3*a*, numerals (0), (1), (2), (3), (4), (5), (6), (7), (8), (9), (10), (11), (12), (13), (14), (15), (16), and (17) will be used to correlate the equations with locations upon the structure illustrated in FIG. 1 and the thermodynamic state diagram illustrated in FIG. 2.

The computerized calculations can be conducted serially around each of the systems A and B, in the same order as the modeling of the various zones of flow which follow, and beginning with known or specified conditions at (1). While many variant calculation plans are possible, herein it is assumed that all pipe cross-sectional areas are specified and mass flow rates of the carrier and of the refrigerant fluid are specified, as well as the evaporator temperature and the carrier temperature at (1) and the superheat of the refrigerant fluid at (1). Certain vertical distances are also specified although others are solved for, as is discussed specifically for each zone of flow. Finally, the saturated and superheated thermodynamic properties of the refrigerant fluid are considered known and available for the computerized calculations in the form of functions or tabular data.

In each zone in which the flow is two-phase, the refrigerant fluid bubbles are assumed to have a drift velocity relative to the carrier. Wherever needed, the local drift velocity is calculated based on local bubble size and density, with a reference value at a reference bubble size and density being supplied as a known value and constant throughout the calculations. This reference value can be determined experimentally for specific designs of the refrigerant fluid bubble-forming device at (1). The local drift velocity is obtained from it as follows. It is assumed that all bubbles are the same size and density at a given depth, but that bubble size and density vary with depth; thus the changing bubble velocity relative to the carrier is accounted for. Each bubble is in equilibrium under the action of a buoyant force and a fluid-mechanical drag force, $$F_B = (\rho_l - \rho_f) g \pi D^3/6$$

$$F_D = \frac{C_D \rho_l D^2 V_r^2 \pi}{8}$$

$$C_D = \frac{24\mu_l}{\rho_l V_r D}$$

and at equilibrium conditions, these result in $$V_r = \frac{(\rho_l - \rho_f) g D^2}{18\mu_l} \tag{1}$$

The reference condition subscripted R is introduced. It is assumed that the bubbles do not subdivide or combine; therefore the mass of each bubble is conserved during its downward travel, $$\frac{\pi \rho_f D^3}{6} = \frac{\pi \rho_{fR} D_R^3}{6}$$

which results in $$D^2 = \frac{18 V_{rR} \mu_l}{(\rho_l - \rho_{fR}) g} \left(\frac{\rho_{fR}}{\rho_f}\right)^{\frac{2}{3}}$$

and when entered into equation (1) this gives $$V_r = V_{rR} \left(\frac{\rho_l - \rho_f}{\rho_l - \rho_{fR}}\right) \left(\frac{\rho_{fR}}{\rho_f}\right)^{\frac{2}{3}} \tag{2}$$

which describes how the local $V_r$ value changes from the reference value of $V_{rR}$ due to changes in diameter and density of the refrigerant fluid bubbles as they travel downward. It is noted that the bubble diameter does not have to be specified although it is implicitly involved in the specified value of $V_{rR}$.

The density of the carrier is taken to be constant throughout. Modeling of the various flow zones follows.

Entrainment Process (1)→(2)

With $\dot{m}_l$, $\dot{m}_f$, $A_d$, $A_t$, $T_{f1}$, $T_{l1}$, $\rho_l$ known, it is assumed that $P_{l1}=p_{f1}=p_1$ and $p_{l2}=p_{f2}=p_2$ and $T_{l2}=T_{f2}$ $T_{l1}=T_2$. Thus the entrainment process is idealized as one in which the flow is in pressure equilibrium at (1) and (2), and in which the refrigerant fluid and carrier have the same temperature at (2), due to heat transfer from the carrier to the bubbles. The very small temperature decrease of the carrier during the entrainment process is ignored. In this zone, fluid friction and the weight of the carrier and the refrigerant fluid are ignored corresponding with the assumption that entrainment occurs in a very small vertical distance; thus $d_{12}=0$, approximately.

If the entrainer is of a concentric tube type, the linear momentum conservation equation is $$p_{f1}A_t+p_{l1}(A_d-A_t)-p_2A_d=\dot{m}_lV_{l2}+\dot{m}_f(V_{l2}-V_{r2})-\dot{m}_lV_{l1}-\dot{m}_fV_{f1} \quad (3)$$

and the mass conservation equation is $$\dot{m}_f=\rho_{f2}(V_{l2}-V_{r2})\left(A_d-\frac{\dot{m}_l}{\rho_lV_{l2}}\right) \quad (4)$$

which is a combination of the conservation equations for the separate phases. In process (1)→(2), no energy equation is needed because the isothermal carrier flow assumption is effectively a solution of that equation. In the computerized solution of the flow for process (1)→(2), equations (2), (3) and (4) are solved simultaneously, iteratively, using the refrigerant fluid thermodynamic property data locally, as earlier discussed. The solution results in values of $p_2$, $V_{l2}$, $V_{f2}$, and $V_{r2}$.

If the entrainer is of the "tee" type, the linear momentum equation is slightly different.

$$p_{l1}A_d-p_2A_d=\dot{m}_f(V_{l2}-V_{r2})-\dot{m}_lV_{l1} \quad (3a)$$

Flow in down pipe below gas entrainment zone, while vapor is superheated, (2)→(3)

An element of the downward flow is considered; in the computerized implementation of the analysis the resulting finite-difference equations are solved stepwise, serially from (2)→(3). The computer program stops the process and gives the location of (3) when the pressure reaches a designated pressure less than the saturation pressure of the refrigerant fluid at the carrier (and refrigerant fluid) temperature. It is assumed that $p_l=p_f=p$ and $T_l=T_f=T$ at any depth. $dz>0$, $g>0$ and $z>0$ downward. The equation for linear momentum conservation is:

$$pA_d-(p+dp)A_d+\rho_fA_fgdz+\rho_lA_lgdz-\frac{f\rho_lV_l^2s_ddz}{8}=\dot{m}_l(V_l+dV_l-V_l)+\dot{m}_f[V_l-V_r)+d(V_l-V_r)-(V_l-V_r)] \quad (5)$$

and using the flow rate equations $$m_l=\rho_lA_lV_l \text{ and } \dot{m}_f=\rho_fA_f(V_l-V_r)$$

and $A_f+A_l=A_d$ equation (5) becomes $$dpA_d-\left(\frac{\dot{m}_l}{V_l}+\frac{\dot{m}_f}{(V_l-V_r)}\right)gdz+\frac{f\rho_lV_l^2s_ddz}{8}+(\dot{m}_l+\dot{m}_f)dV_l-\dot{m}_fdV_r=0 \quad (6)$$

The equation for conservation of mass is $$\dot{m}_f=\rho_f(V_l-V_r)\left(A_d-\frac{\dot{m}_l}{\rho_lV_l}\right) \quad (7)$$

which after differentiation with respect to z is written as $$dV_l=-\frac{\left[\frac{d\rho_f}{\rho_f}-\frac{dV_r}{(V_l-V_r)}\right]}{\left[\frac{1}{(V_l-V_r)}+\frac{1}{V_l\left(\frac{\rho_lV_lA_d}{\dot{m}_l}-1\right)}\right]} \quad (8)$$

A differentiated form of equation (2) is $$dV_r=-\frac{V_{rR}}{(\rho_l-\rho_{fR})}\left(\frac{\rho_{fR}}{\rho_f}\right)^{\frac{2}{3}}\left[1+\frac{2}{3}\frac{(\rho_l-\rho_f)}{\rho_f}\right]d\rho_f \quad (9)$$

The flow is almost isothermal; an approximate form of the equation for energy conservation is used $$\dot{m}_f(h_{zf}-h_{2f})-\dot{m}_l(T_2-T_2)c_l=0 \quad (10)$$

where z is measured downward from station (2) and the enthalpies are obtained from the thermodynamic property data discussed earlier. The use of this approximate form simplifies the iterative problem that must be solved in the step-wise downward solution is zone (2)→(3), in which equations (2), (6), (8), (9) and (10) are solvent simultaneously, and using local thermodynamic properties, iteratively. Fluid friction is accounted for by use of the friction factor f. Since f is a function of pipe roughness and local Reynolds number, these items are used locally in an iterative manner in the computerized solution. The results of these calculations are $p_3$, $T_3$, $V_3$, $V_{f3}$, $V_{r3}$ and $d_{23}$.

Exiting of Mixture from Downpipe and Separation of the Phases (3)→(4).

Many types of separators are possible; the simplest is a gravitational separation tank with a long residence time for the fluid, during which separation occurs. The following analysis assumes that type of separator.

There is a 'pressure coefficient', $K_{34}$; a value is assumed for it corresponding with empirical knowledge of the separator performance. $K_{34}$ also includes the exit loss as the fluid leaves the downpipe and enters the separator; it is used as the fraction of the velocity head not recovered (unconventional usage). It is assumed that the separation chamber is large enough that fluid friction for the motion through the tank can be neglected. For $d_{34}>0$ when (3) is below (4) and for incompressible isothermal flow the energy equation is $$\dot{m}_l\left(\frac{p_3}{\rho_l}+\frac{V_{l3}^2}{2}-gd_{34}\right)+\dot{m}_f\left[\frac{p_3}{\rho_f}+\frac{(V_{l3}-V_{f3})^2}{2}-gd_{34}\right]=\dot{m}_l\left(\frac{p_4}{\rho_l}+0+0\right)+\dot{m}_f\left(\frac{p_4}{\rho_f}+0+0\right)+(1-K_{34})\,\dot{m}_l\frac{V_{l3}^2}{2}-(1-K_{34})\,\dot{m}_f\frac{(V_{l3}-V_{f3})^2}{2} \quad (11)$$

in implementation of this equation, together with the law of conservation of mass equation for zone (3)→(4), all terms due to the f phase were dropped since they are very small compared with those due to the l phase. Thus the equation used is $$p_4=p_3-\rho gd_{34}+\rho_l(1-K_{34})\frac{V_{l3}^2}{2} \quad (12)$$

which is solved for $p_4$.

Flow of l phase from separation tank into lower end of carrier return pipe, (4)→(5)

This is a simple process of the carrier passing from the separator through an entrance having a loss coefficient of $K_{45}$, and into the lower end of the carrier return pipe. Thus, with $d_{45}>0$ for (4) above (5), $$\frac{p_4}{\rho_l}+0+0=\frac{p_5}{\rho_l}+\frac{V_5^2}{2}-gd_{45}+K_{45}\frac{V_5^2}{2} \quad (13)$$

or $$p_5=p_4+\rho gd_{45}-\rho_l\frac{V_5^2}{2}-K_{45}\frac{V_5^2}{2}$$

Flow in pipe from separation tank to carrier pump inlet, (5)→(6)

The pump may be located a distance $d_{56}>0$ when (5) is above (6) below the separator carrier outlet in order to keep the pressure at the pump inlet at a pressure large enough to prevent cavitation. There also may be fitting losses characterized by $K_{56}$ and losses due to pipe friction. Thus, $$\frac{p_5}{\rho_l}+\frac{V_5^2}{2}+gd_{56}=\frac{p_6}{\rho_l}+\frac{V_6^2}{2}+0+K_{56}\frac{V_6^2}{2}+\frac{f_{56}V_6^2d_{56}}{2\,d_u}$$

in which it is assumed that the horizontal part of the pipe is negligibly short and that the diameter of the pipe is the same as that of the carrier return pipe. Also, $V_5=V_6$; with $p_6$ specified, it is desired to determine $d_{56}$, thus $$d_{56}=\frac{\dfrac{p_6-p_5}{\rho_l}+\dfrac{K_{56}V_6^2}{2}-\dfrac{V_5^2}{2}}{g-\dfrac{f_{56}V_6^2}{2d_u}} \quad (15)$$

Since (6) is the pump inlet, the next step should be to calculate the pump power. However, the necessary value of $p_7$ is not known. Recalling that conditions at (1) were originally specified to initiate calculations, it is clear that the next calculations should be from (1) to (7), toward the pump.

Flow in carrier return pipe, from top of carrier loop to beginning of entrainment, (10)→(1)

With $d_{101}>0$ for (10) above (1) and with $K_{101}$ as the loss coefficient and assuming that the horizontal distance between (10) and (1) is negligible compared with the vertical distance, $$\frac{p_{10}}{\rho_l}+\frac{V_{10}^2}{2}+gd_{101}=\frac{p_1}{\rho_l}+\frac{V_{l1}^2}{2}+0+\frac{f_{101}V_{10}^2d_{101}}{2d_u}+K_{101}\frac{V_{10}^2}{2} \quad (16)$$

With $V_{10}=V_5$, this can be solved for $p_{10}$, $$p_{10}=p_1-\rho gd_{101}-\rho_l\frac{V_{l1}^2}{2}+\frac{\rho_lV_{10}^2}{2}\left(K_{101}+\frac{f_{101}d_{101}}{2d_u}-1\right) \quad (17)$$

Flow in carrier return pipe from top of heat exchanging tubes to top of carrier loop, (9)→(10)

Assuming horizontal distance between (9) and (10) is negligibly small compared with vertical distance, $$\frac{p_9}{\rho_l}+\frac{V_9^2}{2}+0=\frac{p_{10}}{\rho_l}+\frac{V_{10}^2}{2}+gd_{910}+\frac{fd_{910}V_9^2}{2d_u}+K_{910}\frac{V_9^2}{2} \quad (18)$$

and with $V_9=V_{10}$, $$p_9=p_{10}+\rho_l\left(gd_{910}+\frac{fd_{910}V_9^2}{2d_u}+K_{910}\frac{V_9^2}{2}\right) \quad (19)$$

Flow in carrier return pipe from bottom of heat exchanging tubes to top of heat exchanging tubes, (8)→(9)

The heat exchanging tubes cause an additional pressure loss, characterized by $K_{89}$.

$$\frac{p_8}{\rho_l}+\frac{V_8^2}{2}+0=\frac{p_9}{\rho_l}+\frac{V_9^2}{2}+gd_{89}+\frac{f_{89}d_{89}V_9^2}{2d_u}+K_{89}\frac{V_9^2}{2} \quad (20)$$

and with $V_8=V_9$, $$p_8=p_9+\rho_l\left(gd_{89}+\frac{f_{89}d_{89}V_9^2}{2d_u}+K_{89}\frac{V_9^2}{2}\right) \quad (21)$$

Flow in carrier return pipe from pump outlet to bottom of heat exchanging tubes, (7)→(8)

Allow for bends, fittings with $K_{78}$. Then, $$\frac{p_7}{\rho_l} + \frac{V_7^2}{2} + 0 = \frac{p_8}{\rho_l} + \frac{V_8^2}{2} + gd_{78} + K_{78}\frac{V_8^2}{2} + \frac{f_{78}d_{78}V_{78}^2}{2d_u} \quad (22)$$

in which it is assumed that horizontal distances are negligible. Hence, with $V_7 = V_8$, $$p_7 = p_8 + \rho_l\left(gd_{78} + K_{78}\frac{V_8^2}{2} + \frac{f_{78}d_{78}V_{78}^2}{2d_u}\right) \quad (23)$$

The carrier pump power, (6)→(7)

Clearly, $$\Delta p_{wp} = p_7 - p_6.$$

Then $$P_{wp} = \dot{m}_l\left(\frac{\Delta p_{wp}}{\rho_l}\right)\left(\frac{1}{\eta_{wp}}\right) \quad (24)$$

This completes modeling of the carrier loop, system A.

Flow of refrigerant fluid from separation tank, through semiconventional vapor refrigerant compressor, (4)→(11)→(12)

Assume that gravitational potential energy terms and kinetic energy terms are negligible compared with other terms. Neglect fluid friction in the (short) piping and neglect entrance and fitting losses.

The compressor must increase the pressure of the refrigerant fluid enough that it can later be liquified in the heat exchanging tubes, which are cooled by the flow of carrier in the carrier return pipe. To accomplish this, assume that the compressor discharge pressure is $\Delta p_{AS}$ above the saturation pressure of refrigerant fluid at the temperature of the carrier in the carrier return pipe, $T_8$. Then $$p_{12} = p, \text{ (saturation for refrigerant at } T_8) + \Delta p_{AS} \quad (25)$$

The complete thermodynamic state leaving the compressor is needed (see FIG. 2). Since $p_{11} = p_4$ and $T_{11} = T_3$, all known, state 1 is known, including the entropy $S_1$ and $h_{f11}$. State 12S is at the same entropy, but at known pressure $p_{12}$; those two properties establish the value of $h_{f12S}$. The ideal (isentropic) work for the compressor is given by $$h_{f11} = h_{f12S} = W_s \text{ or } W_s = h_{f11} - h_{f12S}\ (W_s < 0) \quad (26)$$

For a compression with efficiency $\eta_c$ the actual work W is $$W = W_s/\eta_c \quad (W < 0)$$

and the power that must be supplied to the compressor is $$P_{comp} = |\dot{m}_f W| = \dot{m}_f\frac{(h_{f12S} - h_{f11})}{\eta_c} \quad (27)$$

also, $P_{comp} > 0$

-continued $$h_{f12} = h_{f11} - W_s \quad (W_s < 0) \quad (28)$$

Flow of refrigerant fluid through the heat exchanging tubes, (12)→(13)

Neglect kinetic energy terms and assume that liquid refrigerant fluid leaves the tubes at a saturated condition. Then $$h_{f12} + gd_{1213} = h_{fg13} + q_{f1213}$$

Assume a pressure loss (drop) for the refrigerant fluid passing through the tubes such that $$p_{13} = p_{12} - \Delta p_{he} \quad (28)$$

with $$\Delta p_{he} = K_{1213}\left(\frac{V_{f12}^2}{2}\right) \quad (29)$$

For a specified refrigerant fluid pipe diameter $d_{f12}$, $$V_{f12} = \frac{4\dot{m}_f}{\pi d_{f12}^2 \rho_{f12}} \quad (30)$$

where all thermodynamic properties are "looked up" at local conditions; thus all liquid refrigerant fluid properties are the saturated liquid values at state 13.

Flow of liquid refrigerant fluid from bottom of heat exchanging tubes to liquid refrigerant pump inlet, (13)→(14)

Assume that the horizontal distance is negligibly small compared with the vertical distance $d_{1314} > 0$ for (13) above (14). The cross-sectional area of the pipe is $A_{fu}$ and the diameter is $d_{fu}$. Thus $$V_{13} = V_{14} = \frac{\dot{m}_f}{\rho_{f13} A_{fu}} \quad (31)$$

where $\rho_{f13}$ is the density of saturated liquid refrigerant fluid at $T_{13}$. Now with $V_{13} = V_{14}$, $$p_{14} = p_{13} + \rho_{f13}\left(gd_{1314} - \frac{f_{1314}d_{1314}V_{13}^2}{2d_{fu}} - K_{1314}\frac{V_{13}^2}{2}\right) \quad (32)$$

where $K_{1314}$ is a loss coefficient to account for fittings.

Flow of liquid refrigerant fluid from liquid refrigerant fluid pump outlet to expansion valve, (15)→(16)

Since $V_{16} = V_{15}$ and $\rho_{f16} = \rho_{f15} = \rho_{f14} = \rho_{f13}$ $$p_{15} = p_{16} + \rho_{f16}\left(gd_{1516} + \frac{f_{1516}d_{1516}V_{16}^2}{2d_{fu}} + K_{1516}\frac{V_{16}^2}{2}\right) \quad (33)$$

$p_{16}$ is prescribed by introducing a 'safety factor' excess pressure of $\Delta p_{ev}$ at (16); this is the pressure at (16) in excess of the saturation pressure of refrigerant fluid at temperature $T_{13}$ and is for the purpose of being certain that the refrigerant fluid is liquid at (16). Therefore, $$p_{16}=p_{\text{ (saturation at } T_{13})}+\Delta p_{ev} \quad (34)$$

Flow through the liquid refrigerant fluid pump, (14)→(15)

With $p_{14}$ and $p_{13}$ known, $$\Delta p_{fp} = p_{15} - p_{14} \qquad \Delta p_{fp} > 0 \quad (35)$$

$$P_{fp} = \dot{m}_f\left(\frac{\Delta p_{fp}}{\rho_{f14}}\right)\left(\frac{1}{\eta_{fp}}\right) \qquad P_{fp} > 0 \quad (36)$$

Expansion valve flow (throttle) (16)→(17)

The kinetic energy change is neglected and the potential energy change is neglected. Hence, the applicable equation is $$h_{f16}=h_{f17}=h_{ff17}+x_{17}h_{ffg17}. \quad (37)$$

This is used to solve for $x_{17}$. The temperature at the inlet of the evaporator, $T_{17}$, being prescribed as input data, $p_{17}$ is known to be the corresponding saturation pressure for the refrigerant fluid.

Flow through the evaporator, to the beginning of the entrainment zone, (17)→(0)

The kinetic energy and the potential energy difference across the evaporator are neglected and a pressure drop, $\Delta p_{evap}$, is prescribed. Thus, $$p_0=p_{17}-\Delta p_{evap} \quad (38)$$

The amount of superheat, $\Delta T_{SH}$, for the refrigerant fluid leaving the evaporator is prescribed. The temperature $T_1$ is the saturation temperature for the refrigerant fluid corresponding with $p_1$ and it is also prescribed. Thus $$T_0=T_1+\Delta T_{SH} \quad (39)$$

The above mathematical model indicates equations that are sufficient in the computer program to calculate all pressures, temperatures, energy states, velocities, vertical distances and pump pressure increases throughout the system, for any specified rate of refrigeration and evaporator inlet temperature and outlet superheat.

From the calculated state values, all interesting performance quantities can be calculated, as follows.

Required input power and refrigeration obtained $$P_{tot}=P_{wp}+P_{fp}+P_{comp} \quad (40)$$

The refrigeration obtained is $$\dot{Q}_{ref}=\dot{m}_f(h_{f0}-h_{f17}) \quad (41)$$

The coefficient of performance is a dimensionless quantity given by $$COP=\dot{Q}_{ref}/P_{tot} \quad (42)$$

The quantity (hp/ton) is also interesting and is calculated using $P_{tot}$ in hp units and $\dot{Q}_{ref}$ as tons of refrigeration.

In summary of the mathematical model described above, the performance values do not consider pump efficiency or air circulating fan power; however, these efficiencies are simple to incorporate by simple manual calculation. All other real world inefficiencies are accounted for with the level of the idealization given in the introduction to the mathematical analysis.

A variant of the present invention is illustrated in FIG. 4, which variant embodies multi-staging. For ease of explanation, reference numerals common to the systems depicted in FIG. 1 will be employed in FIG. 4. In a first stage, I, partial compression of the refrigerant fluid to approximately one half of the pressure necessary for liquification occurs. Final pressurization to liquify the refrigerant fluid occurs in stage II. The gaseous refrigerant fluid is introduced to stage I through an entrainer 60, which entrainer may be equivalent to venturi 26, for mixing with a carrier flowing through down pipe 62. The mixture of gaseous refrigerant fluid and carrier is separated in separator 64. The carrier is drawn off through pipe 66 to pump 68 wherefrom it is pumped upwardly through pipe 70 to outlet 72 in communication with entrainer 60.

The partially compressed gaseous refrigerant fluid is drawn off through pipe 74 wherethrough it is conveyed to another entrainer 76, which may be like venturi 26. No pumping of the gaseous refrigerant fluid through pipe 74 is required as the pressure within separator 64 acting upon the refrigerant fluid is sufficient to obtain transmission at a sufficient flow rate. Entrainment of the partially compressed gaseous refrigerant fluid within stage II and subsequent separation of the refrigerant fluid in liquid state is duplicative of that described above with reference to FIG. 1; accordingly, this process need not be repetitively disclosed.

The advantages of multi-staging include: (1) reduction in total necessary vertical height of down pipes 62, 14, which reduction is approximately one half of the value attendant the system shown in FIG. 1 assuming the same carrier density; and (2) there is a possible increase in efficiency or coefficient of performance (COP) as stage II can operate with a lesser quantity of carrier due to the high density of the partially compressed bubbles of gaseous refrigerant fluid entrained therein. It is to be noted that there exists an optimum volume ratio of refrigerant fluid to carrier; accordingly, each of stages I and II may be more nearly at that optimum value then can be obtained in a single stage system wherein the ratio will vary substantially.

It may be further noted that in a system such as described in U.S. Pat. No. 4,311,025, multi-staging is feasible and would require two rotating compressors with separation therebetween. The advantage derived is an increased efficiency due to better optimization of the refrigerant/carrier ratio. Some hybridization may also be effected such as the employment of a rotating compressor to effect partial compression of the refrigerant fluid in stage I and final compression of the refrigerant fluid in a semi-conventional low pressure ratio compressor.

Referring to FIG. 5 there is shown a further variant of the present invention incorporating a semi-conventional or low pressure ratio compressor at the top of the system. For ease of recognition, reference numerals depicting elements common with those shown in FIG. 1 will be employed. The gaseous refrigerant fluid separated in separator 18 is conveyed through pipe 80 to a semi-conventional, low pressure ratio, compressor 82. It may be recalled that the gaseous refrigerant fluid discharged from the separator is at a pressure just below that necessary for conversion to a liquid state. The transmission or flow of the gaseous refrigerant fluid through pipe 80 will be of its own accord to a level generally commensurate with that of the evaporator due to the pressures inherent in the system. For this reason, compressor 82 may be located in general proximity to the height of the evaporator. Liquid refrigerant fluid is conveyed through pipe 84 to a small conventional condenser 86. Any gaseous refrigerant fluid within pipe 84 is separated by a separator 88 and conveyed through pipe 90 to a heat exchanger 92 located within and subjected to flow of the carrier through pipe 24. Sufficient cooling of the refrigerant fluid occurs within the heat exchanger to convert the refrigerant fluid to a liquid state. The liquid refrigerant fluid is conveyed therefrom through pipe 94 into pipe 96, which pipe interconnects condenser 86 with expansion valve 50 to direct liquid refrigerant fluid into the expansion valve.

By assuring that the discharge pressure of the semi-conventional compressor is large enough to insure that the refrigerant liquid is still in a liquid state at the elevation attendant the inlet to expansion valve 50, the pump for pumping liquid refrigerant fluid (shown in FIG. 1) is no longer necessary and may be eliminated.

Placing the semi-conventional compressor at the upper elevation of the system increases the necessary power for the compressor because its inlet pressure is somewhat lower due to the pressure decrease encountered by the gaseous or vaporous refrigerant fluid traveling to the higher elevation through pipe 80. Moreover, the pressure at the outlet of the compressor remains approximately the same as with the system depicted in FIG. 1. It therefore becomes self-evident that the pressure ratio across compressor 82 must be somewhat greater than that of the equivalent compressor earlier described. To offset this additional input power requirement, it may be noted that the power formerly necessary to operate the liquid refrigerant fluid pump is reduced since the liquid refrigerant fluid need, at worst case, be raised a much lesser elevation; or, the liquid refrigerant fluid pump may be eliminated altogether. In the latter event, not only is there a reduction in power requirement but the costs attendant a liquid refrigerant fluid pump are obviated.

Presently it is not known whether a net increase or decrease in power requirements is achieved but intuitively one must come to the conclusion that a reduction in costs should be possible.

The system described herein has a wide spectrum of use. It may be employed and configured to be merely a precooler and precompressor system operating in conjunction with a conventional compressor. In such case, most of the power required for operation would be consumed by the conventional compressor and the gist of the invention would be used primarily to improve the coefficient of performance by a small amount. At the other end of the spectrum, maximum use of the invention would be made and the power requirements of the semi-conventional compressor would be minimal. In such case, the only purpose for using the semi-conventional compressor would be to avoid separation of the liquid refrigerant fluid from water mixed therewith, which avoidance is believed to be very difficult to accomplish. At this end of the spectrum of use of the invention, the coefficient of efficiency is substantially greater than that of a conventional refrigeration system.

To reiterate, the basic process of compression in the part of a hybrid refrigeration system employing the present invention is isothermal whereas the basic process of compression in the semi-conventional part of the hybrid refrigeration system is adiabatic. In general, isothermal compression requires less power than adiabatic compression; the power reduction requirement represents the primary advantage of a hybrid refrigeration system using minimally a semi-conventional compressor.

The change in elevation required by the down pipe can be varied by using carriers of different densities provided that other requirements of non-miscibility with the refrigerant fluid, etc., are satisfied. A reduction in vertical elevation can also be effected by adding numerous small dense particles to the carrier to increase its effective density. The particles can be metallic, glass or of other materials. However, it is not known whether the particles should be spherical or some other shape. It is further believed that any density increase by addition of such particles is approximately the reciprocal of the percentage by which the height of the down pipe may be reduced. It is anticipated that some problems may result, such as plugging, were the flow temporarily stopped by the particles or difficulty may arise in having the plugged particles pass through the carrier pump, the entrainer or other passage restrictions. However, the use of weighted particles in various chemical processes are well known and are successfully pumped. In example, weighting material is often added to oil well drilling mud to increase its density.

It is contemplated that the various pipes employed may be of the commercially available flexible type; similarly, the tanks or containers may be flexible. The obvious resulting advantages include ease of installation, maintenance and cost.

Specifically, thick wall flexible plastic pipes can be used for the down pipe and the up pipe. It is contemplated that the internal pressures will retain the pipes circular and stiff. To decrease the stress within the flexible pipe walls, water or other liquid medium can be provided to encapsulate the outer surface of the flexible pipes to essentially balance the pressures upon opposed sides of the pipe walls. A particular commercial advantage available from using flexible pipes is that of being able to completely manufacture a system within a manufacturing facility, which would allow strict quality control measures at the factory. Other advantages include shipment of a complete system in collapsed form and installation by simply "unrolling" the system at a site. Such construction techniques may be particularly suitable for home air conditioning systems in the consumer market.

The carrier may be water, as discussed in the above referenced patents, or it may be liquid Freon, such as Freon 113 of the type that remains liquid at all temperatures and pressures encountered within the system. It may also be any one of a wide variety of other liquids that are compatible with the refrigerant fluid. The refrigerant fluid may be one of the various Freons or any one of a wide variety of other fluids that are compatible with the carrier.

Electrical or other shaft power must be provided to drive the carrier pump, the liquid refrigerant fluid pump (when used) and the gaseous refrigerant fluid compressor. The gaseous refrigerant fluid compressor may be (superficially) a conventional refrigeration compressor. However, it would have the special operating conditions of very small pressures and very low (ambient) entrance temperature. For these reasons, it must be especially designed for this use. It would consume only a small fraction (less than 20%) of the power used by a compressor in a conventional refrigeration system because most of the necessary work for compression of the refrigerant fluid is supplied by the carrier pump pumping the carrier through the down pipe.

The essence of the present invention lies in separation of the refrigerant fluid from the carrier while the refrigerant fluid is still in a gaseous state because the process of separation is greatly simplified. This feature is very preferable, even when the carrier is water, and may be of substantial commercial significance over conventional refrigeration systems.

It is to be understood that the circulating carrier must be cooled by transfer of heat from it to a thermal sink provided by nature. This may be accomplished by use of a secondary flow loop using a coolant, such as water, pumped through an atmospheric cooling tower (not shown). The transfer of heat from the coolant to the atmosphere in the tower cools the coolant to less than atmospheric temperature. The coolant would then be passed through a heat exchanger (not shown) preferably located in operative relationship with the carrier up pipe. Necessarily, continuous make up coolant would be required due to evaporation at the cooling tower. Alternatively, a conventional evaporative cooler could be used to produce air very much cooler than atmospheric air. The cooled air could then be used to cool the carrier, perhaps by passing it over multitudinous fins formed on the carrier up pipe. A further advantage exists for using an evaporative cooler to cool the carrier when the system is employed for residential air conditioning. The evaporative cooler can be arranged to cool the residence directly over most of the cooling season. When refrigeration is needed, such as during high humidity conditions, it can be redirected to cool the carrier. This is a special application of what is called a "compound" or "piggyback" system which type of system is already in use with conventional air conditioning systems in various areas of the southwest.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

We claim:

1. A two stage method for compressing and withdrawing heat from a refrigerant fluid within a refrigeration system having an evaporator and an expansion valve, said method comprising the steps of:

(a) establishing a downward flow of a fluid non-miscible with the refrigerant fluid within a down pipe and establishing a downward flow of a further fluid non-miscible with the refrigerant fluid within a further down pipe;

(b) conveying the refrigerant fluid in a gaseous state from the evaporator to the upper end of the down pipe;

(c) entraining the gaseous refrigerant fluid within the downward flow of a non-miscible fluid to compress the refrigerant fluid without altering its state;

(d) separating the gaseous refrigerant fluid from the non-miscible fluid at the lower end of the down pipe;

(e) withdrawing the separated gaseous refrigerant fluid from the lower end of the down pipe and conveying it to the upper end of the further down pipe;

(f) entraining the gaseous refrigerant fluid within the downward flow of the further non-miscible fluid to compress the refrigerant fluid;

(g) withdrawing the separated refrigerant fluid from the lower end of the further down pipe and conveying it to the expansion valve;

(h) converting the refrigerant fluid withdrawn from the lower end of the further down pipe from a gaseous state by withdrawing heat to convert it to a liquid state prior to conveyance of it to the expansion valve;

(i) maintaining the refrigerant fluid in a liquid state during said step of conveying; and (j) dissipating heat from the non-miscible fluid and from the further non-miscible fluid.

2. The method as set forth in claim 1 including the step of pumping the non-miscible fluid and the further non-miscible fluid from the lower end of the respective down pipes to the upper end of the respective down pipes.

3. A two stage method for converting a gaseous refrigerant fluid expelled from an evaporator in a refrigeration system into a liquid refrigerant fluid introduced to an expansion valve of the refrigeration system by entraining the refrigerant fluid with a carrier non-miscible with the refrigerant fluid, said method comprising the steps of:

(a) entraining the gaseous refrigerant fluid with the carrier;

(b) conveying the carrier and the entrained refrigerant fluid downwardly through a down pipe to increase the pressure thereof in proportion to the depth of the down pipe without changing the state of the refrigerant fluid;

(c) segregating the carrier from the gaseous refrigerant fluid;

(d) transporting the segregated gaseous refrigerant fluid to a further down pipe;

(e) entraining the gaseous refrigerant fluid with a further carrier in the further down pipe;

(f) conveying the further carrier and the entrained refrigerant fluid downwardly through the further down pipe;

(g) segregating the further carrier from the refrigerant fluid;

(h) withdrawing the segregated further carrier;

(i) converting the segregated gaseous refrigerant fluid to a liquid state by withdrawing heat from it;

(j) conveying the segregated liquid refrigerant fluid to the expansion valve; and (k) withdrawing heat from the carrier and the further carrier.

4. The method as set forth in claim 3 including the step of pumping the segregated carrier and the further segregated carrier to the upper end of the respective down pipe.

5. The method as set forth in claim 4 including the step of pumping the liquid refrigerant fluid to the expansion valve.

6. Apparatus for compressing and withdrawing heat from the refrigerant fluid in a refrigeration system, which refrigeration system includes an expansion valve and an evaporator, said apparatus comprising in combination:

I. a first stage for acting upon the refrigerant fluid, said first stage comprising:
(a) a first down pipe for conveying downwardly the refrigerant fluid in a gaseous state;
(b) a first fluid non-miscible with the refrigerant fluid;
(c) first means for introducing said first non-miscible fluid into said first down pipe and urge downward flow therethrough;
(c) means for conveying the refrigerant fluid in a gaseous state from the evaporator to said first down pipe;
(e) first means for entraining the refrigerant fluid within said first non-miscible fluid flowing downwardly through said first down pipe to convey the refrigerant fluid downwardly and compress the refrigerant fluid by the head of said first non-miscible fluid to a pressure short of converting the refrigerant fluid from a gaseous state to a liquid state;
(f) a first separation chamber disposed at the lower end of said first down pipe for receiving and segregating the gaseous refrigerant fluid and said first non-miscible fluid;
(g) means for withdrawing the gaseous refrigerant fluid from said first separation chamber and conveying it to the expansion valve;
(h) said withdrawing and conveying means including an heat exchanger for converting the refrigerant fluid from a gaseous state to a liquid state;
(i) pump means for maintaining the refrigerant fluid in a liquid state within said withdrawing and conveying means between said converting means and the expansion valve;
(j) heat sink means for dissipating heat from said first non-miscible fluid;

II. a second stage for acting upon the gaseous refrigerant fluid withdrawn from said first separation chamber and prior to conveying of same to the expansion valve, said second stage comprising:
(a) a second fluid non-miscible with the refrigerant fluid;
(b) said withdrawing and conveying means including a second means for entraining with said second non-miscible fluid the gaseous refrigerant fluid withdrawn from said first separation chamber;
(c) a second down pipe;
(d) second means for introducing said second non-miscible fluid into said second down pipe to urge downward flow therethrough; and
(e) a second separation chamber for receiving the gaseous refrigerant fluid and said second non-miscible fluid from said second down pipe and for segregating the gaseous refrigerant fluid from said second non-miscible fluid.

7. The apparatus as set forth in claim 6 wherein said introducing means includes a pump for pumping said first non-miscible fluid from said first separation chamber to said first down pipe through said heat exchanger.

8. The apparatus as set forth in claim 7 wherein the refrigerant fluid comprises freon and the non-miscible fluid comprises water.

9. The apparatus as set forth in claim 7 including a refrigerant fluid pump downstream of said separation chamber and upstream of said heat exchanger for compressing the refrigerant fluid while it is in a gaseous state.

10. The apparatus as set forth in claim 6 wherein said heat exchanger is downstream of said second separation chamber.

11. The apparatus as set forth in claim 10 including a pump downstream of said second separation chamber and upstream of said heat exchanger.

12. The apparatus as set forth in claim 6 wherein said converting means includes a compressor for converting substantially all of the gaseous refrigerant fluid into a liquid state.

13. The apparatus as set forth in claim 12 wherein said heat exchanger is downstream of said compressor for converting to a liquid state any gaseous refrigerant fluid flowing from said compressor.

14. The apparatus as set forth in claim 13 including a condenser for receiving the flow of liquid refrigerant fluid from said compressor and means for bypassing the flow of gaseous refrigerant fluid around said condenser and through said heat exchanger.

15. Apparatus for converting a gaseous refrigerant fluid expelled from an evaporator in a refrigeration system into a liquid refrigerant fluid introduced to an expansion valve of the refrigeration system by entraining the refrigerant fluid with a first carrier non-miscible with the refrigerant fluid, said apparatus comprising in combination:
(a) means for entraining the gaseous refrigerant fluid with the first carrier;
(b) a first down pipe for conveying the first carrier and the entrained refrigerant fluid downwardly and increasing the pressure thereof in proportion to the depth of said first down pipe while retaining the refrigerant fluid as an entrained gaseous refrigerant fluid;
(c) a first separation chamber disposed at the lower end of said first down pipe for receiving and segregating the downwardly flowing first carrier and entrained refrigerant fluid;
(d) means for withdrawing the first carrier from said first separation chamber;
(e) means for converting the gaseous refrigerant fluid segregated within said first separation chamber to a liquid state, said converting means including an heat exchanger and a second carrier;
(f) means for conveying the refrigerant fluid in liquid state to the expansion valve;
(g) means for withdrawing heat from the first carrier;
(h) a second entraining means for entraining within the second carrier the gaseous refrigerant fluid flowing from said first separation chamber;
(i) a second down pipe for compressing the second carrier and entrained refrigerant fluid;
(j) a second separation chamber for receiving and segregating the refrigerant fluid and the second carrier; and
(k) further means for withdrawing heat from the second carrier.

16. The apparatus as set forth in claim 15 wherein said conveying means includes a pump.

17. The apparatus as set forth in claim 16 wherein said withdrawing means includes pump means for transporting the carrier to said entraining means.

18. The apparatus as set forth in claim 15 wherein the refrigerant fluid is freon and the non-miscible fluid is water.

19. The apparatus as set forth in claim 15 wherein said heat exchanger is downstream of said second separation chamber.

20. The apparatus as set forth in claim 19 including means for pumping the refrigerant fluid from said second separation chamber to said heat exchanger.

21. The apparatus as set forth in claim 15 wherein said converting means comprises a compressor for converting substantially all of the gaseous refrigerant fluid into a liquid state.

22. The apparatus as set forth in claim 21 including a condenser for receiving the flow of liquid refrigerant fluid from said compressor and means for bypassing the flow of gaseous refrigerant around said condenser and through said heat exchanger.

* * * * *

UNITED STATES PATENT AND TRADEMARK OFFICE

CERTIFICATE OF CORRECTION

PATENT NO. : 4,424,681

DATED : January 10, 1984

INVENTOR(S) : Warren Rice and Craig Hosterman

It is certified that error appears in the above-identified patent and that said Letters Patent are hereby corrected as shown below:

In column 19, line 9, delete "(c)" and substitute therefor --(d)--.

Signed and Sealed this

First Day of May 1984

[SEAL]

*Attest:*

GERALD J. MOSSINGHOFF

*Attesting Officer*

*Commissioner of Patents and Trademarks*